US008590497B2

(12) United States Patent
Meldolesi et al.

(10) Patent No.: US 8,590,497 B2
(45) Date of Patent: Nov. 26, 2013

(54) SPLIT-CYCLE AIR-HYBRID ENGINE WITH EXPANDER DEACTIVATION

(75) Inventors: Riccardo Meldolesi, Shoreham-by-Sea (GB); Nicholas Badain, Shoreham-by-Sea (GB); Ian Gilbert, Shoreham-by-Sea (GB)

(73) Assignee: Scuderi Group, Inc., West Springfield, MA (US)

( * ) Notice: Subject to any disclaimer, the term of this patent is extended or adjusted under 35 U.S.C. 154(b) by 262 days.

(21) Appl. No.: 13/046,825

(22) Filed: Mar. 14, 2011

(65) Prior Publication Data

US 2011/0220079 A1 Sep. 15, 2011

Related U.S. Application Data

(60) Provisional application No. 61/313,831, filed on Mar. 15, 2010, provisional application No. 61/363,825, filed on Jul. 13, 2010, provisional application No. 61/365,343, filed on Jul. 18, 2010.

(51) Int. Cl.

| | |
|---|---|
| ***F02B 25/00*** | (2006.01) |
| ***F02B 75/22*** | (2006.01) |
| ***F02B 25/08*** | (2006.01) |
| ***F02B 75/28*** | (2006.01) |
| ***F01B 7/12*** | (2006.01) |

(52) U.S. Cl.

USPC ..... 123/70 R; 123/51 R; 123/55.1; 123/55.3; 123/55.5; 123/55.4; 123/55.2; 123/71 R; 123/69 R; 123/51 AC; 123/51 BC; 123/51 BD; 123/431

(58) Field of Classification Search

USPC ..... 123/70 R, 51 R, 51.1, 51.3, 51.5, 51.4, 123/51.2, 71 R, 69 R, 51 AC, 51 BC, 51 BD, 123/431

See application file for complete search history.

(56) References Cited

U.S. PATENT DOCUMENTS 1,062,999 A * 5/1913 Webb ..... 60/626
4,565,167 A * 1/1986 Bryant ..... 123/70 R (Continued)

FOREIGN PATENT DOCUMENTS

JP 2006-517638 7/2006
JP 2009-522502 6/2009

(Continued)

OTHER PUBLICATIONS

English language abstract for JP2009-522502.

(Continued)

*Primary Examiner* — Lindsay Low
*Assistant Examiner* — Charles Brauch
(74) *Attorney, Agent, or Firm* — Fildes & Outland, P.C.

(57) ABSTRACT

A split-cycle air-hybrid engine includes a rotatable crankshaft. A compression piston is slidably received within a compression cylinder and operatively connected to the crankshaft. An expansion piston is slidably received within an expansion cylinder and operatively connected to the crankshaft. An exhaust valve selectively controls gas flow out of the expansion cylinder. A crossover passage interconnects the compression and expansion cylinders. The crossover passage includes a crossover compression (XovrC) valve and a crossover expansion (XovrE) valve therein. An air reservoir is operatively connected to the crossover passage. An air reservoir valve selectively controls air flow into and out of the air reservoir. In an Air Compressor (AC) mode of the engine, the XovrE valve is kept closed during an entire rotation of the crankshaft, and the exhaust valve is kept open for at least 240 CA degrees of the same rotation of the crankshaft.

14 Claims, 2 Drawing Sheets

(56) References Cited

U.S. PATENT DOCUMENTS

| | | | | |
|---|---|---|---|---|
| 4,696,158 | A * | 9/1987 | DeFrancisco | 60/39.62 |
| 6,415,749 | B1 * | 7/2002 | Sturman et al. | 123/70 R |
| 6,655,327 | B1 * | 12/2003 | Hedman | 123/68 |
| 7,353,786 | B2 * | 4/2008 | Scuderi et al. | 123/68 |
| 7,513,224 | B2 * | 4/2009 | Heaton | 123/51 R |
| 7,607,503 | B1 * | 10/2009 | Schechter | 180/165 |
| 7,634,988 | B1 * | 12/2009 | Salminen | 123/663 |
| 2007/0157894 | A1 * | 7/2007 | Scuderi et al. | 123/70 R |
| 2008/0202454 | A1 * | 8/2008 | Pirault | 123/58.8 |
| 2009/0038597 | A1 * | 2/2009 | Phillips | 123/70 R |
| 2010/0051003 | A1 * | 3/2010 | Negre et al. | 123/70 R |
| 2011/0017181 | A1 * | 1/2011 | Lou | 123/70 R |

FOREIGN PATENT DOCUMENTS

| | | |
|---|---|---|
| JP | 2010-529354 | 8/2010 |
| JP | 2010-529355 | 8/2010 |

OTHER PUBLICATIONS

English language abstract for JP2010-529354.
English language abstract for JP2010-529355.
English language abstract for JP2006-517638.

* cited by examiner

SPLIT-CYCLE AIR-HYBRID ENGINE WITH EXPANDER DEACTIVATION

CROSS-REFERENCE TO RELATED APPLICATIONS

This application claims the priority of U.S. Provisional Application No. 61/313,831 filed Mar. 15, 2010, U.S. Provisional Application No. 61/363,825 filed Jul. 13, 2010, and U.S. Provisional Application No. 61/365,343 filed Jul. 18, 2010.

TECHNICAL FIELD

This invention relates to split-cycle engines and, more particularly, to such an engine incorporating an air-hybrid system.

BACKGROUND OF THE INVENTION

For purposes of clarity, the term "conventional engine" as used in the present application refers to an internal combustion engine wherein all four strokes of the well-known Otto cycle (i.e., the intake (or inlet), compression, expansion (or power) and exhaust strokes) are contained in each piston/cylinder combination of the engine. Each stroke requires one half revolution of the crankshaft (180 degrees crank angle (CA)), and two full revolutions of the crankshaft (720 degrees CA) are required to complete the entire Otto cycle in each cylinder of a conventional engine.

Also, for purposes of clarity, the following definition is offered for the term "split-cycle engine" as may be applied to engines disclosed in the prior art and as referred to in the present application.

A split-cycle engine as referred to herein comprises:

a crankshaft rotatable about a crankshaft axis;

a compression piston slidably received within a compression cylinder and operatively connected to the crankshaft such that the compression piston reciprocates through an intake stroke and a compression stroke during a single rotation of the crankshaft;

an expansion (power) piston slidably received within an expansion cylinder and operatively connected to the crankshaft such that the expansion piston reciprocates through an expansion stroke and an exhaust stroke during a single rotation of the crankshaft; and a crossover passage (port) interconnecting the compression and expansion cylinders, the crossover passage including at least a crossover expansion (XovrE) valve disposed therein, but more preferably including a crossover compression (XovrC) valve and a crossover expansion (XovrE) valve defining a pressure chamber therebetween.

U.S. Pat. No. 6,543,225 granted Apr. 8, 2003 to Scuderi and U.S. Pat. No. 6,952,923 granted Oct. 11, 2005 to Branyon et al., both of which are incorporated herein by reference, contain an extensive discussion of split-cycle and similar-type engines. In addition, these patents disclose details of prior versions of an engine of which the present disclosure details further developments.

Split-cycle air-hybrid engines combine a split-cycle engine with an air reservoir and various controls. This combination enables a split-cycle air-hybrid engine to store energy in the form of compressed air in the air reservoir. The compressed air in the air reservoir is later used in the expansion cylinder to power the crankshaft.

A split-cycle air-hybrid engine as referred to herein comprises:

a crankshaft rotatable about a crankshaft axis;

a compression piston slidably received within a compression cylinder and operatively connected to the crankshaft such that the compression piston reciprocates through an intake stroke and a compression stroke during a single rotation of the crankshaft;

an expansion (power) piston slidably received within an expansion cylinder and operatively connected to the crankshaft such that the expansion piston reciprocates through an expansion stroke and an exhaust stroke during a single rotation of the crankshaft;

a crossover passage (port) interconnecting the compression and expansion cylinders, the crossover passage including at least a crossover expansion (XovrE) valve disposed therein, but more preferably including a crossover compression (XovrC) valve and a crossover expansion (XovrE) valve defining a pressure chamber therebetween; and an air reservoir operatively connected to the crossover passage and selectively operable to store compressed air from the compression cylinder and to deliver compressed air to the expansion cylinder.

U.S. Pat. No. 7,353,786 granted Apr. 8, 2008 to Scuderi et al., which is incorporated herein by reference, contains an extensive discussion of split-cycle air-hybrid and similar-type engines. In addition, this patent discloses details of prior hybrid systems of which the present disclosure details further developments.

A split-cycle air-hybrid engine can be run in a normal operating or firing (NF) mode (also commonly called the Engine Firing (EF) mode) and four basic air-hybrid modes. In the EF mode, the engine functions as a non-air hybrid split-cycle engine, operating without the use of its air reservoir. In the EF mode, a tank valve operatively connecting the crossover passage to the air reservoir remains closed to isolate the air reservoir from the basic split-cycle engine.

The split-cycle air-hybrid engine operates with the use of its air reservoir in four hybrid modes. The four hybrid modes are:

1) Air Expander (AE) mode, which includes using compressed air energy from the air reservoir without combustion;
2) Air Compressor (AC) mode, which includes storing compressed air energy into the air reservoir without combustion;
3) Air Expander and Firing (AEF) mode, which includes using compressed air energy from the air reservoir with combustion; and
4) Firing and Charging (FC) mode, which includes storing compressed air energy into the air reservoir with combustion.

However, further optimization of these modes, EF, AE, AC, AEF and FC, is desirable to enhance efficiency and reduce emissions.

SUMMARY OF THE INVENTION

The present invention provides a split-cycle air-hybrid engine in which the use of the Air Compressor (AC) mode is optimized for potentially any vehicle in any drive cycle for improved efficiency.

More particularly, an exemplary embodiment of a split-cycle air-hybrid engine in accordance with the present invention includes a crankshaft rotatable about a crankshaft axis. A compression piston is slidably received within a compression cylinder and operatively connected to the crankshaft such that the compression piston reciprocates through an intake stroke and a compression stroke during a single rotation of the crankshaft. An expansion piston is slidably received within an expansion cylinder and operatively connected to the crankshaft such that the expansion piston reciprocates through an expansion stroke and an exhaust stroke during a single rotation of the crankshaft. An exhaust valve selectively controls gas flow out of the expansion cylinder. A crossover passage interconnects the compression and expansion cylinders. The crossover passage includes a crossover compression (XovrC) valve and a crossover expansion (XovrE) valve defining a pressure chamber therebetween. An air reservoir is operatively connected to the crossover passage and selectively operable to store compressed air from the compression cylinder and to deliver compressed air to the expansion cylinder. An air reservoir valve selectively controls air flow into and out of the air reservoir. The engine is operable in an Air Compressor (AC) mode. In the AC mode, the XovrE valve is kept closed for an entire rotation of the crankshaft, and the exhaust valve is kept open for at least 240 CA degrees of the same rotation of the crankshaft.

A method of operating a split-cycle air-hybrid engine is also disclosed. The split-cycle air-hybrid engine includes a crankshaft rotatable about a crankshaft axis. A compression piston is slidably received within a compression cylinder and operatively connected to the crankshaft such that the compression piston reciprocates through an intake stroke and a compression stroke during a single rotation of the crankshaft. An expansion piston is slidably received within an expansion cylinder and operatively connected to the crankshaft such that the expansion piston reciprocates through an expansion stroke and an exhaust stroke during a single rotation of the crankshaft. An exhaust valve selectively controls gas flow out of the expansion cylinder. A crossover passage interconnects the compression and expansion cylinders. The crossover passage includes a crossover compression (XovrC) valve and a crossover expansion (XovrE) valve defining a pressure chamber therebetween. An air reservoir is operatively connected to the crossover passage and selectively operable to store compressed air from the compression cylinder and to deliver compressed air to the expansion cylinder. An air reservoir valve selectively controls air flow into and out of the air reservoir. The engine is operable in an Air Compressor (AC) mode. The method in accordance with the present invention includes the following steps: keeping the XovrE valve closed for an entire rotation of the crankshaft; and keeping the exhaust valve open for at least 240 CA degrees of the same rotation of the crankshaft, whereby the expansion cylinder is deactivated to reduce pumping work performed by the expansion piston on air in the expansion cylinder.

These and other features and advantages of the invention will be more fully understood from the following detailed description of the invention taken together with the accompanying drawings.

DETAILED DESCRIPTION OF THE INVENTION

Figure 1:
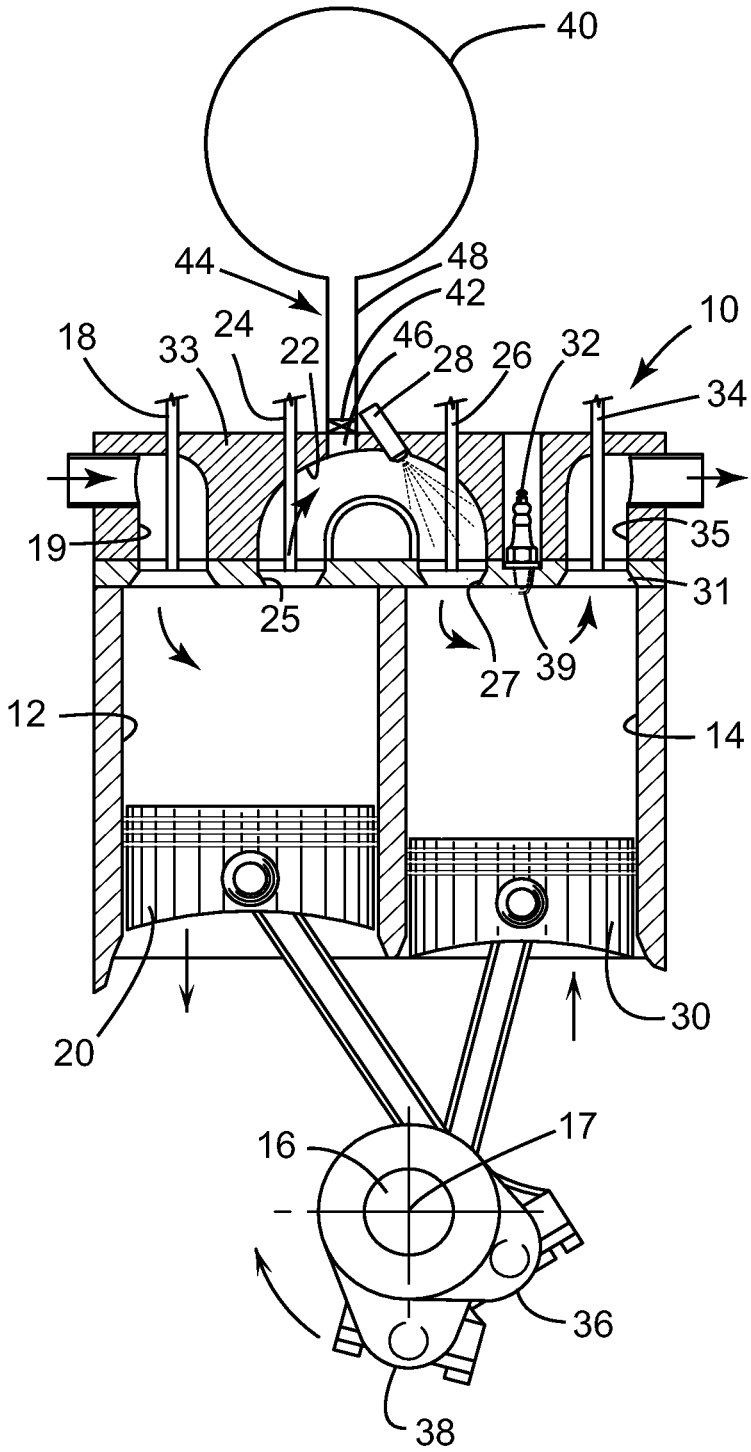
FIG. 1 is a lateral sectional view of an exemplary split-cycle air-hybrid engine in accordance with the present invention.

The following glossary of acronyms and definitions of terms used herein is provided for reference.

In General

Unless otherwise specified, all valve opening and closing timings are measured in crank angle degrees after top dead center of the expansion piston (ATDCe).

Unless otherwise specified, all valve durations are in crank angle degrees (CA).

Air tank (or air storage tank): Storage tank for compressed air.

ATDCe: After top dead center of the expansion piston.

Bar: Unit of pressure, 1 bar=$10^5$ N/$m^2$

BMEP: Brake mean effective pressure. The term "Brake" refers to the output as delivered to the crankshaft (or output shaft), after friction losses (FMEP) are accounted for. Brake Mean Effective Pressure (BMEP) is the engine's brake torque output expressed in terms of a mean effective pressure (MEP) value. BMEP is equal to the brake torque divided by engine displacement. This is the performance parameter taken after the losses due to friction. Accordingly, BMEP=IMEP-friction. Friction, in this case is usually also expressed in terms of an MEP value known as Frictional Mean Effective Pressure (or FMEP).

Compressor: The compression cylinder and its associated compression piston of a split-cycle engine.

Exhaust (or EXH) valve: Valve controlling outlet of gas from the expander cylinder.

Expander: The expansion cylinder and its associated expansion piston of a split-cycle engine.

FMEP: Frictional Mean Effective Pressure.

IMEP: Indicated Mean Effective Pressure. The term "Indicated" refers to the output as delivered to the top of the piston, before friction losses (FMEP) are accounted for.

Inlet (or intake): Inlet valve. Also commonly referred to as the intake valve.

Inlet air (or intake air): Air drawn into the compression cylinder on an intake (or inlet) stroke.

Inlet valve (or intake valve): Valve controlling intake of gas into the compressor cylinder.

Pumping work (or pumping loss): For purposes herein, pumping work (often expressed as negative IMEP) relates to that part of engine power which is expended on the induction of the fuel and air charge into the engine and the expulsion of combustion gases.

Residual Compression Ratio during expansion cylinder deactivation: The ratio (a/b) of (a) the trapped volume in the expansion cylinder at the position just when the exhaust valve closes to (b) the trapped volume in the expansion cylinder just as the expansion piston reaches its top dead center position (i.e., the clearance volume).

RPM: Revolutions Per Minute.

Tank valve: Valve connecting the Xovr passage with the compressed air storage tank.

VVA: Variable valve actuation. A mechanism or method operable to alter the shape or timing of a valve's lift profile.

Xovr (or Xover) valve, passage or port: The crossover valves, passages, and/or ports which connect the compression and expansion cylinders through which gas flows from compression to expansion cylinder.

XovrE (or XoverE) valves: Valves at the expander end of the crossover (Xovr) passage.

XovrE-clsd-Exh-open: XovrE valve fully closed and Exhaust valve fully open.

XovrE-clsd-Exh-std: XovrE valve fully closed and Exhaust valve having standard timing.

XovrE-open-Exh-clsd: XovrE valve fully open and Exhaust valve fully closed.

XovrE-open-Exh-std: XovrE valve fully open and Exhaust valve having standard timing.

XovrE-std-Exh-std: XovrE valve having standard timing and Exhaust valve having standard timing.

Referring to FIG. 1, an exemplary split-cycle air-hybrid engine is shown generally by numeral 10. The split-cycle air-hybrid engine 10 replaces two adjacent cylinders of a conventional engine with a combination of one compression cylinder 12 and one expansion cylinder 14. A cylinder head 33 is typically disposed over an open end of the expansion and compression cylinders 12, 14 to cover and seal the cylinders.

The four strokes of the Otto cycle are "split" over the two cylinders 12 and 14 such that the compression cylinder 12, together with its associated compression piston 20, perform the intake and compression strokes, and the expansion cylinder 14, together with its associated expansion piston 30, perform the expansion and exhaust strokes. The Otto cycle is therefore completed in these two cylinders 12, 14 once per crankshaft 16 revolution (360 degrees CA) about crankshaft axis 17.

During the intake stroke, intake air is drawn into the compression cylinder 12 through an intake port 19 disposed in the cylinder head 33. An inwardly opening (opening inwardly into the cylinder and toward the piston) poppet intake valve 18 controls fluid communication between the intake port 19 and the compression cylinder 12.

During the compression stroke, the compression piston 20 pressurizes the air charge and drives the air charge into the crossover passage (or port) 22, which is typically disposed in the cylinder head 33. This means that the compression cylinder 12 and compression piston 20 are a source of high-pressure gas to the crossover passage 22, which acts as the intake passage for the expansion cylinder 14. In some embodiments, two or more crossover passages interconnect the compression cylinder 12 and the expansion cylinder 14.

The geometric (or volumetric) compression ratio of the compression cylinder 12 of split-cycle engine 10 (and for split-cycle engines in general) is herein commonly referred to as the "compression ratio" of the split-cycle engine. The geometric (or volumetric) compression ratio of the expansion cylinder 14 of split-cycle engine 10 (and for split-cycle engines in general) is herein commonly referred to as the "expansion ratio" of the split-cycle engine. The geometric compression ratio of a cylinder is well known in the art as the ratio of the enclosed (or trapped) volume in the cylinder (including all recesses) when a piston reciprocating therein is at its bottom dead center (BDC) position to the enclosed volume (i.e., clearance volume) in the cylinder when said piston is at its top dead center (TDC) position. Specifically for split-cycle engines as defined herein, the compression ratio of a compression cylinder is determined when the XovrC valve is closed. Also specifically for split-cycle engines as defined herein, the expansion ratio of an expansion cylinder is determined when the XovrE valve is closed.

Due to very high compression ratios (e.g., 20 to 1, 30 to 1, 40 to 1, or greater) within the compression cylinder 12, an outwardly opening (opening outwardly away from the cylinder) poppet crossover compression (XovrC) valve 24 at the crossover passage inlet 25 is used to control flow from the compression cylinder 12 into the crossover passage 22. Due to very high expansion ratios (e.g., to 1, 30 to 1, 40 to 1, or greater) within the expansion cylinder 14, an outwardly opening poppet crossover expansion (XovrE) valve 26 at the outlet 27 of the crossover passage 22 controls flow from the crossover passage 22 into the expansion cylinder 14. The actuation rates and phasing of the XovrC and XovrE valves 24, 26 are timed to maintain pressure in the crossover passage 22 at a high minimum pressure (typically 20 bar or higher at full load) during all four strokes of the Otto cycle.

At least one fuel injector 28 injects fuel into the pressurized air at the exit end of the crossover passage 22 in correspondence with the XovrE valve 26 opening, which occurs shortly before expansion piston 30 reaches its top dead center position. The air/fuel charge enters the expansion cylinder 14 when expansion piston 30 is close to its top dead center position. As piston 30 begins its descent from its top dead center position, and while the XovrE valve 26 is still open, spark plug 32, which includes a spark plug tip 39 that protrudes into cylinder 14, is fired to initiate combustion in the region around the spark plug tip 39. Combustion can be initiated while the expansion piston is between 1 and 30 degrees CA past its top dead center (TDC) position. More preferably, combustion can be initiated while the expansion piston is between 5 and 25 degrees CA past its top dead center (TDC) position. Most preferably, combustion can be initiated while the expansion piston is between 10 and 20 degrees CA past its top dead center (TDC) position. Additionally, combustion may be initiated through other ignition devices and/or methods, such as with glow plugs, microwave ignition devices or through compression ignition methods.

During the exhaust stroke, exhaust gases are pumped out of the expansion cylinder 14 through exhaust port 35 disposed in cylinder head 33. An inwardly opening poppet exhaust valve 34, disposed in the inlet 31 of the exhaust port 35, controls fluid communication between the expansion cylinder 14 and the exhaust port 35. The exhaust valve 34 and the exhaust port 35 are separate from the crossover passage 22. That is, exhaust valve 34 and the exhaust port 35 do not make contact with, or are not disposed in, the crossover passage 22.

With the split-cycle engine concept, the geometric engine parameters (i.e., bore, stroke, connecting rod length, volumetric compression ratio, etc.) of the compression 12 and expansion 14 cylinders are generally independent from one another. For example, the crank throws 36, 38 for the compression cylinder 12 and expansion cylinder 14, respectively, may have different radii and may be phased apart from one another such that top dead center (TDC) of the expansion piston 30 occurs prior to TDC of the compression piston 20. This independence enables the split-cycle engine 10 to potentially achieve higher efficiency levels and greater torques than typical four-stroke engines.

The geometric independence of engine parameters in the split-cycle engine 10 is also one of the main reasons why pressure can be maintained in the crossover passage 22 as discussed earlier. Specifically, the expansion piston 30 reaches its top dead center position prior to the compression piston reaching its top dead center position by a discreet phase angle (typically between 10 and 30 crank angle degrees). This phase angle, together with proper timing of the XovrC valve 24 and the XovrE valve 26, enables the split-cycle engine 10 to maintain pressure in the crossover passage 22 at a high minimum pressure (typically 20 bar absolute or higher during full load operation) during all four strokes of its pressure/volume cycle. That is, the split-cycle engine 10 is operable to time the XovrC valve 24 and the XovrE valve 26 such that the XovrC and XovrE valves are both open for a substantial period of time (or period of crankshaft rotation) during which the expansion piston 30 descends from its TDC position towards its BDC position and the compression piston 20 simultaneously ascends from its BDC position towards its TDC position. During the period of time (or crankshaft rotation) that the crossover valves 24, 26 are both open, a substantially equal mass of air is transferred (1) from the compression cylinder 12 into the crossover passage 22 and (2) from the crossover passage 22 to the expansion cylinder 14. Accordingly, during this period, the pressure in the crossover passage is prevented from dropping below a predetermined minimum pressure (typically 20, 30, or 40 bar absolute during full load operation). Moreover, during a substantial portion of the engine cycle (typically 80% of the entire engine cycle or greater), the XovrC valve 24 and XovrE valve 26 are both closed to maintain the mass of trapped gas in the crossover passage 22 at a substantially constant level. As a result, the pressure in the crossover passage 22 is maintained at a predetermined minimum pressure during all four strokes of the engine's pressure/volume cycle.

For purposes herein, the method of having the XovrC 24 and XovrE 26 valves open while the expansion piston 30 is descending from TDC and the compression piston 20 is ascending toward TDC in order to simultaneously transfer a substantially equal mass of gas into and out of the crossover passage 22 is referred to herein as the Push-Pull method of gas transfer. It is the Push-Pull method that enables the pressure in the crossover passage 22 of the split-cycle engine 10 to be maintained at typically 20 bar or higher during all four strokes of the engine's cycle when the engine is operating at full load.

As discussed earlier, the exhaust valve 34 is disposed in the exhaust port 35 of the cylinder head 33 separate from the crossover passage 22. The structural arrangement of the exhaust valve 34 not being disposed in the crossover passage 22, and therefore the exhaust port 35 not sharing any common portion with the crossover passage 22, is preferred in order to maintain the trapped mass of gas in the crossover passage 22 during the exhaust stroke. Accordingly, large cyclic drops in pressure are prevented which may force the pressure in the crossover passage below the predetermined minimum pressure.

XovrE valve 26 opens shortly before the expansion piston 30 reaches its top dead center position. At this time, the pressure ratio of the pressure in crossover passage 22 to the pressure in expansion cylinder 14 is high, due to the fact that the minimum pressure in the crossover passage is typically 20 bar absolute or higher and the pressure in the expansion cylinder during the exhaust stroke is typically about one to two bar absolute. In other words, when XovrE valve 26 opens, the pressure in crossover passage 22 is substantially higher than the pressure in expansion cylinder 14 (typically in the order of 20 to 1 or greater). This high pressure ratio causes initial flow of the air and/or fuel charge to flow into expansion cylinder 14 at high speeds. These high flow speeds can reach the speed of sound, which is referred to as sonic flow. This sonic flow is particularly advantageous to split-cycle engine 10 because it causes a rapid combustion event, which enables the split-cycle engine 10 to maintain high combustion pressures even though ignition is initiated while the expansion piston 30 is descending from its top dead center position.

The split-cycle air-hybrid engine 10 also includes an air reservoir (tank) 40, which is operatively connected to the crossover passage 22 by an air reservoir (tank) valve 42. Embodiments with two or more crossover passages 22 may include a tank valve 42 for each crossover passage 22, which connect to a common air reservoir 40, or alternatively each crossover passage 22 may operatively connect to separate air reservoirs 40.

The tank valve 42 is typically disposed in an air reservoir (tank) port 44, which extends from crossover passage 22 to the air tank 40. The air tank port 44 is divided into a first air reservoir (tank) port section 46 and a second air reservoir (tank) port section 48. The first air tank port section 46 connects the air tank valve 42 to the crossover passage 22, and the second air tank port section 48 connects the air tank valve 42 to the air tank 40. The volume of the first air tank port section 46 includes the volume of all additional ports and recesses which connect the tank valve 42 to the crossover passage 22 when the tank valve 42 is closed.

The tank valve 42 may be any suitable valve device or system. For example, the tank valve 42 may be an active valve which is activated by various valve actuation devices (e.g., pneumatic, hydraulic, cam, electric or the like). Additionally, the tank valve 42 may comprise a tank valve system with two or more valves actuated with two or more actuation devices.

Air tank 40 is utilized to store energy in the form of compressed air and to later use that compressed air to power the crankshaft 16, as described in the aforementioned U.S. Pat. No. 7,353,786 to Scuderi et al. This mechanical means for storing potential energy provides numerous potential advantages over the current state of the art. For instance, the split-cycle engine 10 can potentially provide many advantages in fuel efficiency gains and NOx emissions reduction at relatively low manufacturing and waste disposal costs in relation to other technologies on the market, such as diesel engines and electric-hybrid systems.

By selectively controlling the opening and/or closing of the air tank valve 42 and thereby controlling communication of the air tank 40 with the crossover passage 22, the split-cycle air-hybrid engine 10 is operable in an Engine Firing (EF) mode, an Air Expander (AE) mode, an Air Compressor (AC) mode, an Air Expander and Firing (AEF) mode, and a Firing and Charging (FC) mode. The EF mode is a non-hybrid mode in which the engine operates as described above without the use of the air tank 40. The AC and FC modes are energy storage modes. The AC mode is an air-hybrid operating mode in which compressed air is stored in the air tank 40 without combustion occurring in the expansion cylinder 14 (i.e., no fuel expenditure), such as by utilizing the kinetic energy of a vehicle including the engine 10 during braking. The FC mode is an air-hybrid operating mode in which excess compressed air not needed for combustion is stored in the air tank 40, such as at less than full engine load (e.g., engine idle, vehicle cruising at constant speed). The storage of compressed air in the FC mode has an energy cost (penalty); therefore, it is desirable to have a net gain when the compressed air is used at a later time. The AE and AEF modes are stored energy usage modes. The AE mode is an air-hybrid operating mode in which compressed air stored in the air tank 40 is used to drive the expansion piston 30 without combustion occurring in the expansion cylinder 14 (i.e., no fuel expenditure). The AEF mode is an air-hybrid operating mode in which compressed air stored in the air tank 40 is utilized in the expansion cylinder 14 for combustion.

In the AC mode, the expansion cylinder 14 is preferably deactivated to minimize or substantially reduce pumping work (in terms of negative IMEP) performed by the expansion piston 30 on air in the expansion cylinder. As will be discussed in further detail herein, the most efficient way to deactivate the expansion cylinder 14 is to keep the XovrE valve closed through the entire rotation of the crankshaft 16, and ideally to keep the exhaust valve 34 open through the entire rotation of the crankshaft.

In engine embodiments where the exhaust valve is outwardly opening, the exhaust valve may be kept open through the entire rotation of the crankshaft. However, this exemplary embodiment illustrates the more typical configuration where the exhaust valve 34 is inwardly opening. Therefore, in order to avoid expansion piston 30 to exhaust valve 34 contact at the top of the expansion piston's stroke, the exhaust valve 34 must be closed prior to when the ascending piston 30 makes contact with the inwardly opening valve 34.

Additionally, it is important to insure that the trapped air is not compressed too much from the angle of exhaust valve closing to TDC of the expansion piston in order to avoid excessive temperature and pressure build-up. Generally, this means that the residual compression ratio at the point of exhaust valve 34 closing should be 20 to 1 or less, and more preferably 10 to 1 or less. In exemplary engine 10, the residual compression ratio will be about 20 to 1 at an exhaust valve 34 closing angle (position) of about 60 CA degrees before TDC of the expansion piston 30. When exhaust valve closing is 60 CA degrees before TDC, it is highly desirable (as discussed in greater detail herein) that exhaust valve opening be 60 CA degrees after TDC.

Accordingly, in order to deactivate the expansion cylinder 14 without excessive build-up of air temperature and pressure, it is preferable that the exhaust valve 34 be kept open through at least 240 CA degrees of the rotation of the crankshaft 16. Moreover, it is more preferable that the exhaust valve 34 be kept open through at least 270 CA degrees of the rotation of the crankshaft 16, and it is most preferable that the exhaust valve be kept open through at least 300 CA degrees of rotation of the crankshaft 16.

As the exhaust valve 34 is closed solely in response to avoiding expansion piston 30 to exhaust valve 34 contact, air compression (and therefore negative work) will occur as piston 30 ascends toward its top dead center position (TDC). In order to maximize efficiency, a primary aim is therefore to reopen the exhaust valve 34 at a timing when the pressure in the expansion cylinder 14 is equal to the pressure in the exhaust port 35 (i.e., when the pressure differential between the expansion cylinder and the exhaust port 35 is substantially zero). In an ideal system, the opening timing of the exhaust valve 34 would be symmetrical with the closing timing of the exhaust valve 34 about top dead center of the expansion piston 30. However, in practice, after the exhaust valve 34 closes during the exhaust stroke of the expansion piston 30, the pressure and temperature in the expansion cylinder 14 begins to rise. Some of the heat generated is lost to the cylinder components such as the cylinder walls, the piston crown, and the cylinder head. Therefore, the pressure in the expansion cylinder 14 and exhaust port 35 is equalized at a slightly earlier timing (relative to top dead center) on the expansion stroke of the expansion piston 30 than on the exhaust stroke. In addition, wave effects in the exhaust port 35 and the flow characteristics of the exhaust valve 34 (such as the fact that flow is quite restricted at low valve lifts) result in the optimum closing and opening timing of the exhaust valve 18 deviating slightly from truly symmetrical about top dead center.

Therefore, it is important to keep the closing position (timing) and opening position (timing) of valve 34 substantially (i.e., within plus or minus 10 CA degrees) symmetrical with respect to TDC of piston 30, in order to return as much of the compression work to the crankshaft 16 as possible. For example, if the exhaust valve 34 is closed at substantially 25 CA degrees before TDC of the expansion piston 30 to avoid being hit by the piston 30, then the valve 34 should open at substantially 25 CA degrees after TDC of piston 30. In this way, the compressed air will act as an air spring and return most of the compression work to the crankshaft 16 as the air expands and pushes down on the expansion piston 30 when the piston 30 descends away from TDC.

Accordingly, in order to avoid expansion piston 30 to exhaust valve 34 contact and to reverse as much compression work as possible, it is preferable that the closing and opening positions (timing) of valve 34 are symmetrical, within plus or minus 10 CA degrees, about TDC of expansion piston 30 (e.g., if exhaust valve 34 closes at 25 CA degrees before TDC, then it must open at 25 plus or minus 10 CA degrees after TDC of piston 30). However, it is more preferable if the closing and opening positions of valve 34 are symmetrical, within plus or minus 5 CA degrees, about TDC of piston 30, and most preferable if the closing and opening positions of valve 34 are symmetrical, within plus or minus 2 CA degrees, about TDC of piston 30.

Also, in the AC mode, the air tank valve 42 is preferably opened when the air pressure in the crossover passage 22 is higher than the air pressure in the air tank 40. This ensures that compressed air will flow into the air tank 40 for storage, and that compressed air will substantially be prevented from leaking out of the air tank. The compression piston 20 draws intake air into the compression cylinder 12 and compresses the intake air. The compressed air is then stored in the air tank 40.

Figure 2:
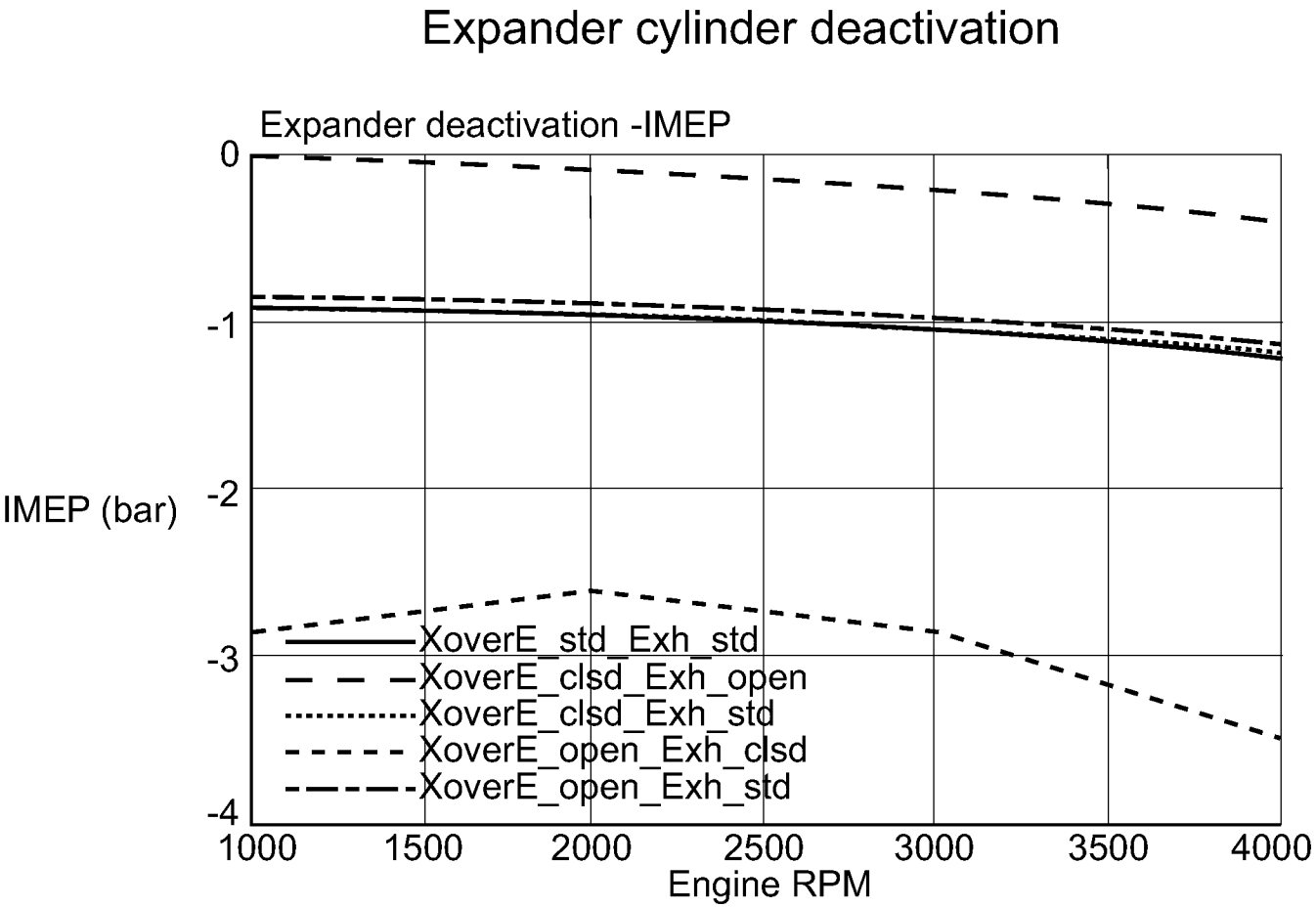
FIG. 2 is a graphical illustration of pumping load (in terms of negative IMEP) versus engine speed in accordance with the present invention.

As shown in FIG. 2 graph labeled: XoverE_open_Exh_clsd, the greatest pumping losses (in terms of negative IMEP) occur in the AC mode if the XovrE valve is kept open and the exhaust valve is kept closed. The pumping work in this arrangement also generally increases with engine speed.

Referring to FIG. 2 graphs labeled: XoverE_std_Exh_std, XoverE_clsd_Exh_std, and XoverE_open_Exh_std, the pumping losses are reduced at nearly equal amounts from the XoverE_open_Exh_clsd arrangement if either: (i) the XovrE valve and the exhaust valve are operated with standard timing (e.g., the timing used for the EF mode); (ii) the XovrE valve is kept closed and the exhaust valve is operated with standard timing; or (iii) the XovrE valve is kept open and the exhaust valve is operated with standard timing.

Referring to FIG. 2 graph labeled: XoverE_clsd_Exh_open, as discussed earlier, the pumping losses are reduced even further (to nearly zero at low engine speeds) if the expansion cylinder is deactivated by keeping the XovrE valve closed and the exhaust valve open. In this arrangement, the expansion piston draws in exhaust air from the exhaust port during its power stroke and pushes air back into the exhaust port during its exhaust stroke. A minimum amount of compression work is done, since the exhaust valve 34 is closed only in response to avoiding contact with expansion piston 30. Additionally, most of that compression work is reversible when the opening and closing timings of exhaust valve 34 are substantially symmetrical relative to TDC of the expansion piston 30. Thus, it is apparent that expansion cylinder deactivation minimizes and substantially reduces pumping work performed by the expansion piston in the AC mode.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A split-cycle air-hybrid engine comprising:

a crankshaft rotatable about a crankshaft axis;

a compression piston slidably received within a compression cylinder and operatively connected to the crankshaft such that the compression piston reciprocates through an intake stroke and a compression stroke during a single rotation of the crankshaft;

an expansion piston slidably received within an expansion cylinder and operatively connected to the crankshaft such that the expansion piston reciprocates through an expansion stroke and an exhaust stroke during a single rotation of the crankshaft;

an exhaust valve selectively controlling gas flow out of the expansion cylinder;

a crossover passage interconnecting the compression and expansion cylinders, the crossover passage including a crossover compression (XovrC) valve and a crossover expansion (XovrE) valve defining a pressure chamber therebetween;

an air reservoir operatively connected to the crossover passage and selectively operable to store compressed air from the compression cylinder and to deliver compressed air to the expansion cylinder; and an air reservoir valve selectively controlling air flow into and out of the air reservoir;

the engine being operable in an Air Compressor (AC) mode, wherein, in the AC mode, the XovrE valve is kept closed during an entire rotation of the crankshaft, and the exhaust valve is kept open for at least 240 CA degrees of said entire rotation of the crankshaft; and wherein, in the AC mode, the exhaust valve closing position and the exhaust valve opening position are symmetrical, within plus or minus 10 CA degrees, about the top dead center position of the expansion piston.

2. The split-cycle air-hybrid engine of claim 1, wherein, in the AC mode, the exhaust valve is kept open for at least 270 CA degrees of said entire rotation of the crankshaft.

3. The split-cycle air-hybrid engine of claim 1, wherein, in the AC mode, the exhaust valve is kept open for at least 300 CA degrees of said entire rotation of the crankshaft.

4. The split-cycle air-hybrid engine of claim 1, wherein, in the AC mode, a residual compression ratio at an exhaust valve closing position is 20 to 1 or less.

5. The split-cycle air-hybrid engine of claim 1, wherein, in the AC mode, a residual compression ratio at an exhaust valve closing position is 10 to 1 or less.

6. The split-cycle air-hybrid engine of claim 1, wherein, in the AC mode, the exhaust valve closing position and exhaust valve opening position are symmetrical, within plus or minus 5 CA degrees, about the top dead center position of the expansion piston.

7. The split-cycle air-hybrid engine of claim 1, wherein, in the AC mode, the exhaust valve closing position and exhaust valve opening position are symmetrical, within plus or minus 2 CA degrees, about the top dead center position of the expansion piston.

8. The split-cycle air-hybrid engine of claim 1, wherein, in the AC mode, the compression piston draws in and compresses intake air which is stored in the air reservoir.

9. The split-cycle air-hybrid engine of claim 1, wherein, in the AC mode, the air reservoir valve is opened when air pressure in the crossover passage is higher than air pressure in the air reservoir.

10. A split-cycle air-hybrid engine comprising:

a crankshaft rotatable about a crankshaft axis;

a compression piston slidably received within a compression cylinder and operatively connected to the crankshaft such that the compression piston reciprocates through an intake stroke and a compression stroke during a single rotation of the crankshaft;

an expansion piston slidably received within an expansion cylinder and operatively connected to the crankshaft such that the expansion piston reciprocates through an expansion stroke and an exhaust stroke during a single rotation of the crankshaft;

an exhaust valve selectively controlling gas flow out of the expansion cylinder and into an exhaust port;

a crossover passage interconnecting the compression and expansion cylinders, the crossover passage including a crossover compression (XovrC) valve and a crossover expansion (XovrE) valve defining a pressure chamber therebetween;

an air reservoir operatively connected to the crossover passage and selectively operable to store compressed air from the compression cylinder and to deliver compressed air to the expansion cylinder; and an air reservoir valve selectively controlling air flow into and out of the air reservoir;

the engine being operable in an Air Compressor (AC) mode, wherein, in the AC mode, the XovrE valve is kept closed during an entire rotation of the crankshaft, and the exhaust valve is opened at a position at which pressure in the expansion cylinder is approximately equal to pressure in the exhaust port.

11. A method of operating a split-cycle air-hybrid engine including:

a crankshaft rotatable about a crankshaft axis;

a compression piston slidably received within a compression cylinder and operatively connected to the crankshaft such that the compression piston reciprocates through an intake stroke and a compression stroke during a single rotation of the crankshaft;

an expansion piston slidably received within an expansion cylinder and operatively connected to the crankshaft such that the expansion piston reciprocates through an expansion stroke and an exhaust stroke during a single rotation of the crankshaft;

an exhaust valve selectively controlling gas flow out of the expansion cylinder, a crossover passage interconnecting the compression and expansion cylinders, the crossover passage including a crossover compression (XovrC) valve and a crossover expansion (XovrE) valve defining a pressure chamber therebetween;

an air reservoir operatively connected to the crossover passage and selectively operable to store compressed air from the compression cylinder and to deliver compressed air to the expansion cylinder; and an air reservoir valve selectively controlling airflow into and out of the air reservoir;

the engine being operable in an Air Compressor (AC) mode;

the method including the steps of:

keeping the XovrE valve closed during an entire rotation of the crankshaft;

keeping the exhaust valve open during at least 240 CA degrees of said entire rotation of the crankshaft; and keeping the exhaust valve closing position and the exhaust valve opening position symmetrical, within plus or minus 10 CA degrees, about the top dead center position of the expansion piston;

whereby the expansion cylinder is deactivated to reduce pumping work performed by the expansion piston on air in the expansion cylinder.

12. The method of claim 11, keeping the exhaust valve closing position and the exhaust valve opening position symmetrical, within plus or minus 5 CA degrees, about the top dead center position of the expansion piston.

13. The method of claim 11, further including the steps of drawing intake air into the compression cylinder, compressing the intake air, and storing the compressed air in the air reservoir.

14. The method of claim 11, further including the step of opening the air reservoir valve when air pressure in the crossover passage is higher than air pressure in the air reservoir.

* * * * *